US005424181A

United States Patent [19]

Strauel et al.

[11] Patent Number: 5,424,181

[45] Date of Patent: Jun. 13, 1995

[54] PROCESS FOR PREPARING PHOTOGRAPHIC EMULSIONS HAVING A LOW FOG LEVEL

[75] Inventors: Philippe Strauel, Givry; Gerard A. Friour, Chalon-sur-Saone, both of France

[73] Assignee: Eastman Kodak Company, Rochester, N.Y.

[21] Appl. No.: 213,350

[22] Filed: Mar. 15, 1994

[30] Foreign Application Priority Data

Apr. 2, 1993 [FR] France ..... 93 04145

[51] Int. Cl.[6] ..... G03C 1/005; G03C 1/035

[52] U.S. Cl. ..... 430/569; 430/567

[58] Field of Search ..... 430/567, 569

[56] References Cited

U.S. PATENT DOCUMENTS

| | | | |
|---|---|---|---|
| 2,694,716 | 11/1954 | Allen et al. | 260/304 |
| 4,444,877 | 4/1984 | Koitabashi et al. | 430/567 |
| 4,565,778 | 1/1986 | Miyamoto et al. | 430/567 |
| 4,659,654 | 4/1987 | Metoki et al. | 430/569 |
| 4,668,614 | 5/1987 | Takada et al. | 430/567 |
| 4,686,178 | 8/1987 | Honda et al. | 430/569 |
| 4,777,564 | 10/1988 | Derfiny et al. | 361/405 |
| 4,883,748 | 11/1989 | Hayakawa | 430/567 |
| 4,990,437 | 2/1991 | Iijima et al. | 430/558 |
| 5,124,243 | 6/1992 | Mochizuki et al. | 430/569 |

FOREIGN PATENT DOCUMENTS 0430196 6/1991 European Pat. Off. .

OTHER PUBLICATIONS

T. H. James, The Theory of the Photographic Process, 4th Edition, published by Macmillan, pp. 393–394.

*Primary Examiner*—Charles L. Bowers, Jr.
*Assistant Examiner*—Mark F. Huff
*Attorney, Agent, or Firm*—Carl O. Thomas

[57] ABSTRACT

The invention concerns a process for obtaining emulsions of the core/shell type having a low fog level.

The process consists of precipitating, by the double jet method, a photographic emulsion comprising core-shell silver halide grains, the concentrations of halides varying progressively during at least the formation of the core.

Application to reversal or negative photographic products is disclosed.

16 Claims, 3 Drawing Sheets

PROCESS FOR PREPARING PHOTOGRAPHIC EMULSIONS HAVING A LOW FOG LEVEL

FIELD OF THE INVENTION

The present invention concerns a process for preparing a photographic emulsion, in particular an emulsion consisting of silver halide grains inherently having a low fog level. These emulsions of the negative or reversal type may be used in color photographic products.

BACKGROUND

As is explained in T. H. James, *The Theory of the Photographic Process*, 4th Edition, published by Macmillan, pages 393–394, fog forms in the areas which are not exposed to light under the non-selective action of the developer. Fog may be defined as the density obtained in the parts which have not been exposed to light. Fog may be due to the nature of the emulsion, to the developing, to oxidation by air or to aging.

It is known that fog may be promoted by an increase in sensitivity and it is essential therefore that a reduction in the level of fog does not take place at the cost of a loss of sensitivity.

Normally anti-fogging agents are used to reduce or eliminate the formation of fog. In particular mineral anti-fogging agents such as mercury II salts have been used. For example, European patent 0 352 618 describes the use of a combination comprising a mercury oxide or salt and a benzothiazolium compound for exerting a stabilizing and anti-fogging action.

These mercury derivatives have drawbacks with regard to the environment. Organic compounds or their salts are also used as anti-fogging or stabilizing agents. For example, U.S. Pat. No. 2,694,716 describes the use of salts of polymethylene-bis-benzothiazolium as anti-fogging agents in photographic emulsions. These compounds are not as effective as mercury salts.

Thus the problem of the fog of emulsions is not always satisfactorily resolved and it would be very desirable to be able to have emulsions with characteristics such that the presence of anti-fogging agents would be superfluous.

The aim of the present invention is a process for obtaining an emulsion of the core/shell type having a low fog level when the emulsion has just been prepared or after aging, an emulsion which also has a good compromise between fog and sensitivity. Core/shell emulsion is taken to mean an emulsion in which the silver halides are distributed non-uniformly within the grain. A conventional method for preparing such emulsions consists of forming grains with a multilayer structure by successively precipitating regions with different halide compositions. The central region is normally referred to as the core and the other regions are grouped together under the name shell.

Many patents of the prior art describe bromoiodide emulsions of the core/shell type in which the proportion of iodide varies between the central region and the various regions forming the shell, the central region having the highest proportion of iodide and the outermost region having the lowest proportion of iodide.

U.S. Pat. No. 4,777,564 describes a high-sensitivity photographic emulsion consisting of silver bromoiodide grains with a total silver iodide content of at least 12% molar and in which the iodide is distributed within the grains in at least three regions of silver bromoiodide having different iodide contents, the outermost region having an iodide content less than the total iodide content of the grain. For example, the outermost region has an iodide concentration of 5 to 15% and the central region an iodide concentration of 30 to 70%. This patent gives no information about fog.

U.S. Pat. No. 4,990,437 describes a silver bromoiodide emulsion containing 1 to 20% molar iodide and consisting of 3 to 8 regions. The central region consists of silver bromide or silver bromoiodide. The central region comprises 0 to 40% molar iodide and the outermost region 0 to 10% molar iodide. Between the outermost region and the layer of the shell having the highest iodide content is an intermediate layer having an iodide content which is intermediate with respect to the two layers surrounding it. This intermediate layer has a composition which can be uniform within the layer or else may have a gradient. Amongst the additives in the emulsion are the conventional organic anti-fogging agents and stabilizers.

U.S. Pat. No. 4,444,877 describes a silver bromoiodide emulsion of the core/shell type in which the central region comprises 0.5 to 10% molar iodide preferably distributed uniformly, and the shell does not include any iodide and is preferably a bromide shell. Conventional organic anti-fogging agents are used with this type of emulsion.

U.S. Pat. No. 4,565,778 describes core/shell emulsions consisting of two regions. The difference in iodide concentration between the two regions should be not less than 1% molar; the shell has an iodide content close to 0. The central region may consist of two or more layers having different iodide contents. Although it is said that the iodide content within the grain may vary continuously between two layers, in all the examples the iodide content varies abruptly. These emulsions are used with the conventional organic anti-fogging agents. They have a higher sensitivity and contrast than reference emulsions having a uniform iodide distribution. The sensitivity is improved without increasing the fog by effecting a chemical ripening in the presence of a labile selenium compound.

European patent 0 430 196 describes a process for stabilizing the crystalline morphology of tabular grains of AgCl when the emulsion is subjected to heat treatment such as the treatments used in chemical sensitization for example. In order to obtain these tabular grains containing at least 50% chloride, the central silver chloride region is formed by the double jet method and, into the jet of chloride, a second halide is then introduced in an evenly increasing profile, for example bromide in order to form a chlorobromide shell.

U.S. Pat. No. 4,668,614 describes bromoiodide emulsions of the core/shell type comprising a central region consisting of 10 to 45% molar iodide and a shell consisting of one or two layers, the outermost layer comprising less than 5% molar iodide. The total iodide concentration is 7% molar or more. The shell preferably consists of silver bromide. These emulsions are used in the presence of conventional organic anti-fogging agents. The examples show that they have a low fog level and a higher sensitivity than reference emulsions which do not have two separate regions with very different iodide contents.

Examples in this patent show that different iodide distributions in the shell and core make it possible to have improved sensitivity without increasing fog compared with an emulsion comprising the same amount of iodide distributed uniformly in the grain. However, the problem of fog is resolved only partially since the emulsions in this patent are used with the conventional organic anti-fogging agents.

It can be seen that, in the patents of the prior art describing the preparation of core/shell emulsions, the iodide concentration is generally uniform in the central region but there may be a concentration gradient in the shell. In general, the high iodide gradient at the center of the grain decreases towards the outside of the grain through a succession of regions having a well-defined iodide content. The problem of fog remains, requiring the presence of anti-fogging agents.

SUMMARY OF THE INVENTION

The fog problem is resolved according to the invention with a process for obtaining an emulsion of the core/shell type having a particular grain structure.

Thus one of the advantages of the present invention is to obtain a high-sensitivity emulsion inherently having a fog level so low that this emulsion can be used without anti-fogging agents.

In one aspect this invention is directed to a process for preparing a photographic emulsion comprising silver halide grains with a core/shell structure, in which successive regions having different silver halide compositions are precipitated by introducing simultaneously a solution of a silver salt and a solution of an alkaline metal halide or halides, wherein at least during the precipitation of the core, the halide solution contains at least two different halides, the concentrations of which in the halide solution vary progressively between predetermined initial values and final values which are equal to the concentrations of these halides in the halide solution at the start of the precipitation of the immediately adjacent shell region.

In another aspect the invention is directed to a light-sensitive emulsion comprised of grains containing a core and a surrounding shell, wherein the core contains at least two different halides that vary progressively in concentration from the nucleation site within the grain to the surrounding shell.

PREFERRED EMBODIMENTS

Figure 1:
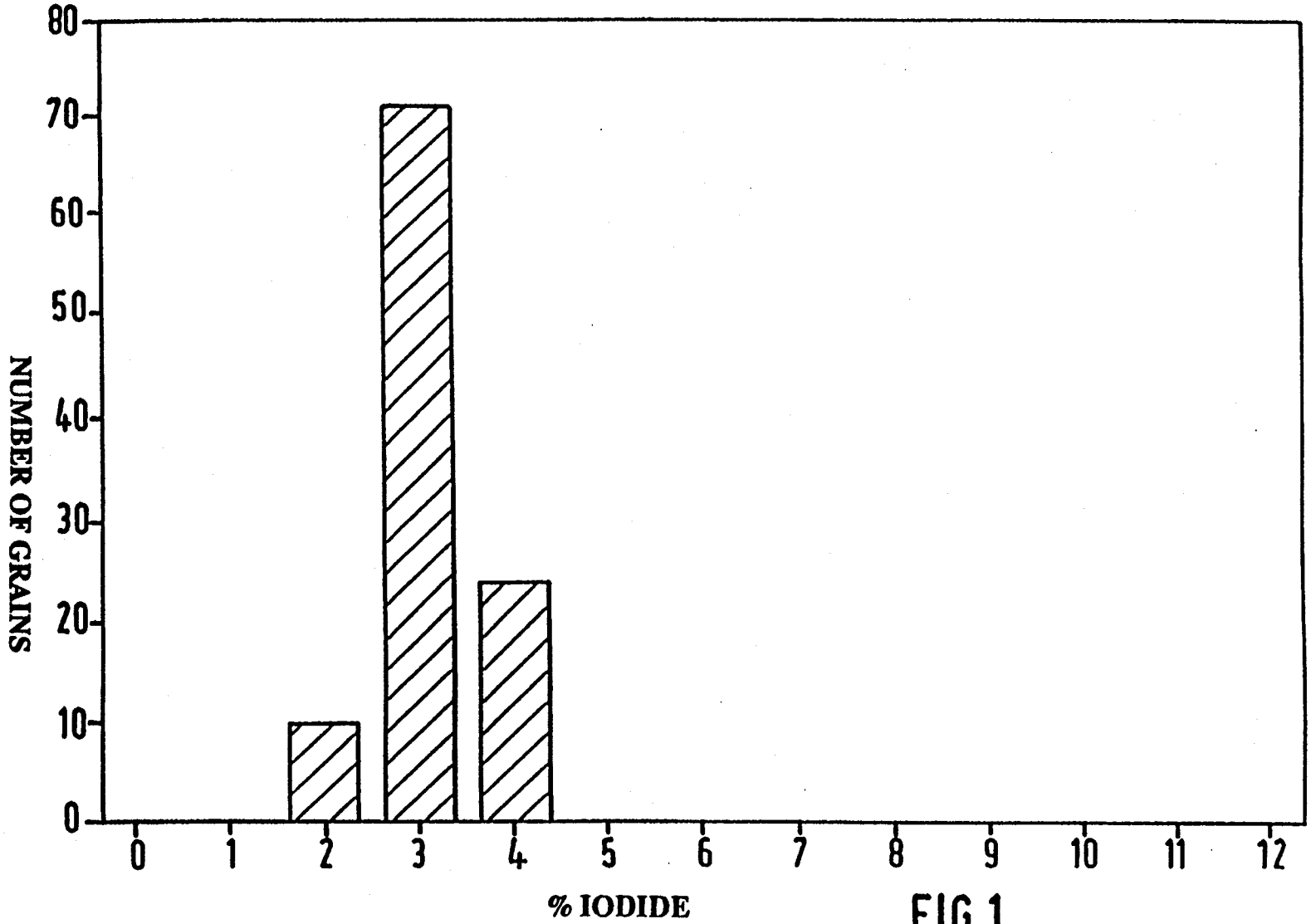
FIG. 1 is a plot of number of grains versus percent iodide.

The process according to the invention is a process for preparing a silver halide photographic emulsion with a core/shell structure which consists of precipitating successive regions having different silver halide compositions by introducing simultaneously a solution of a silver salt and a solution of an alkaline metal halide or halides, hereinafter referred to as a "halide solution" or "halide jet" containing one or more alkaline halides. The process is characterized in that, at least during the precipitation of the central region (the core), the halide solution comprises at least two different halides, the concentrations of which in the halide solution vary progressively between predetermined initial values and final values which are equal to the concentrations of the said halides in the halide solution at the start of the precipitation of the immediately adjacent shell region. When two halides are employed to form the core, the rise in the concentration of one halide is exactly offset by the concentration decline of the remaining halide. When three halides are employed to form the core, the rise in the concentration of one or two halides is exactly offset by the concentration decline of the respective two or one halides remaining. Thus the minimum or maximum concentration of a single halide occurs at the grain nucleation site within the grain while the respective maximum or minimum concentration of the same halide occurs at its interface with the core and intermediate levels of the same halide are present at all intermediate locations within the grain. Further, along a core sectional profile extending from the grain nucleation site to the interface with the shell at least one and preferably all halides present in the core either continuously increase or decrease in concentration. Preferably the progressive variance of halide composition in the core is linear or approximately linear.

This preparation process makes it possible to avoid abrupt variations in the halide composition of the grain at the interface between the core and shell.

The shells surrounding the grain cores can be formed of a single halide or a combination of halides. Further, when a combination of halides are present in the shell, the composition of the shell can be uniform throughout or varied, as illustrated by European Patent 0 430 196 and U.S. Pat. Nos. 4,444,877, 4,565,778, 4,668,614, 4,777,564 and 4,990,437, cited above and here incorporated by reference.

The silver halide emulsion according to the invention is comprised of at least two silver halides chosen from among silver chloride, silver bromide and silver iodide. The composition of grains containing two or more halides is indicated by first naming the halide in the highest concentration and last naming the halide in the lowest concentration. Examples of possible grain compositions are silver chlorobromide, bromoiodide, bromochloride, chloroiodide, bromochloroiodide, chloroiodobromide, bromoiodochloride. For example, in order to obtain an emulsion having a bromoiodide core and bromide shell with the process according to the invention, the central silver bromoiodide region is precipitated by linearly decreasing the concentration of iodide and linearly increasing the concentration of bromide in the jet of halide comprising an alkaline iodide and bromide. In this case the concentration of iodide in the grain varies from a high value at the centre of the grain to a zero value at the core/shell interface.

The grains can have different morphologies, for example tabular, octahedral (faces 111, cubo-octahedral or cubic (faces 100). In a preferred embodiment, the grains are cubo-octahedral.

The emulsions may be intended for negative-positive or reversal processes. They may form latent images predominantly on the surface or within the grains. They may be chemically or spectrally sensitized as described in Research Disclosure, Vol. 308, December 1989, Item 308,119, Sections IV and V.

In the following description, this publication of December 1989 will be referred to as "Research Disclosure". Research Disclosure is published by Kenneth Mason Publications Ltd, Emsworth, Hampshire, PO10 7DQ, England.

These emulsions can contain gelatin or other synthetic binders such as hydrophilic colloids, soluble polymers or mixtures of the latter. Binders useful for the layers of emulsion and the other layers of the photographic products of this invention are described in Research Disclosure Section IX. These binders may be hardened by known processes described in Research Disclosure Section X.

The photographic products according to the invention may contain optical brighteners (Research Disclosure Section V), optionally anti-fogging agents and stabilizers (Research Disclosure Section VI), anti-stain agents and image stabilizers (Research Disclosure Section VII paragraphs I and J), substances absorbing or diffusing light (Research Disclosure Section VIII), hardeners (Research Disclosure Section X), plasticizers or lubricants (Research Disclosure Section XII), anti-static agents (Research Disclosure Section XIII), matting agents (Research Disclosure Section XVI) or development modifiers (Research Disclosure Section XXI).

The layers on the photographic products according to the invention may be applied to various bases described in Research Disclosure Section XVII.

The emulsions may be monodisperse or polydisperse. The size of the grains in these emulsions is determined by volumetric analysis of the silver halide grains, which is carried out by electrolytic reduction. Such a method is described by A Holland and A Feinerman in J. Applied Photo. Eng. 8, 165 (1982). This method makes it possible to obtain the volumetric distribution of the grains. From this distribution it is possible to calculate, using the following formulae, the mean volume of the grains (V) together with the equivalent spherical diameter (ESD) and standard deviation ($\sigma$), $V_i$ being the volume of a given grain and N the number of grains counted.

$$ESD=2(3V/4\sigma)^{\frac{1}{3}} \text{ in } \mu m$$

$$\sigma=[\Sigma(V_i-V)^2/N]^{\frac{1}{2}}$$

The coefficient of variation (COV) being defined by the formula:

$$COV=100\ \sigma/V$$

In the present invention, it is preferred to use emulsions with a coefficient of variation (COV) of less than 25%.

The diameter of the silver halide grains may vary between 0.3 and 2 $\mu$m and preferably between 0.3 and 1.6 $\mu$m.

The silver halides constituting the grain may be distributed within the grain so as to form a central region and one or more regions constituting the shell, at least the central region having been precipitated with a halide profile as described previously. When the shell comprises several regions, abrupt variations in the halide composition at the interface between two regions of the shell are preferably avoided.

The maximum molar silver iodide concentration in the silver bromoiodide regions may reach iodide saturation levels, typically nominally assigned a value of about 40 mole percent iodide, although capable of reaching higher levels, depending on the temperature, as illustrated by U.S. Pat. No. 5,238,804. It is in fact known that the maximum quantity of iodide in a solid solution of AgBr depends on the temperature of formation of the crystal and the formation conditions (see *The Theory of the Photographic Process*, 4th Edition, cited above, page 4). Typically and most conveniently the molar iodide concentration in the silver bromoiodide regions of the grain is between 0.1 and 36%.

In a preferred embodiment of the invention, the molar iodide concentration at the centre of the grain is approximately 36% and at the core/shell interface 0%, that is 18% on average in the central region. The overall molar iodide concentration in the grain is 6% for a core/shell ratio of 1:2.

The thickness of the shell depends on the size of the grain, the large grains having a shell with a greater thickness than the small grains for a given core/shell ratio. By way of example, for a grain size of 0.7 $\mu$m, the shell has a thickness of approximately 0.1 $\mu$m for a core/shell molar ratio of 1:2.

The silver bromoiodide in the central region and the silver bromide in the shell are in a core/shell molar concentration of between 0.2 and 2, and preferably around 0.5.

EXAMPLES

The following examples illustrate the invention and show that the emulsions according to the invention have an acceptable fog level in the absence of anti-fogging compounds.

EXAMPLE 1

Preparation of Reference Emulsions

Using the double jet precipitation technique, a cubo-octahedral emulsion of AgBrI of the core/shell type was prepared as follows:

In a 20 liter heavily agitated vessel containing an aqueous solution of gelatin, NaBr and a growth modifier assisting the formation of cubo-octahedral grains, nucleation was effected at 60° C. and pH 5.1 by introducing over 70 seconds by double jet a 0.5M solution of $AgNO_3$ and a 0.5M solution of NaBr. The flow rate of $AgNO_3$ was constant and the flow rate of NaBr was adjusted so that the pAg remains at 9. (The pAg is the reciprocal of the logarithm of the silver ion concentration in the vessel).

After observing a waiting period, a growth was effected in order to precipitate the AgBrI core onto the AgBr nuclei. To do this, in the solution maintained at 60° C., a 2M solution of $AgNO_3$ was introduced by double jet over 48 minutes with a flow rate of the type a+bt (a and b being constants and t the time in minutes), and the flow rate of halide containing NaBr,NaI (2M) with 18% molar NaI was adjusted so that the pAg is constant and equal to 9. 3.33 moles of AgBrI were precipitated.

The AgBr shell was then formed by introducing, by double jet over 43 minutes, a 2M solution of $AgNO_3$ and a 2M solution of NaBr at 60° C. The flow rate of $AgNO_3$ was constant and the flow rate of NaBr was adjusted so that the pAg remained constant and equal to 9. 6.67 moles of AgBr were precipitated.

Finally the emulsion was washed at 40° C. at a pH of 3.8.

An emulsion was obtained with cubo-octahedral grains having a central AgBrI part with a uniform iodide concentration of 18% molar and a shell of AgBr. The total iodide concentration of the grain was 6% molar and the grain size 0.7 $\mu$m.

The reference emulsion A was prepared by adding a mercury derivative, the complex of bis(2-amino-5-iodopyridine-dihydroiodide) and mercuric iodide, as an anti-fogging agent in the $AgNO_3$ solution at 0.335 moles per mole of silver halide precipitated.

The reference emulsion B was prepared without adding any anti-fogging agent.

EXAMPLE 2

Preparation of Emulsions C and D According to the Invention

The operating method of Example 1 was repeated, except that, during the stage of precipitation of the core, the concentration of iodide in the halide jet decreased linearly as a function of the time between an initial concentration of 36% and a final concentration of 0%. Conversely, the concentration of bromide varied linearly between 64% at the start of precipitation and 100% at the end of the precipitation of the core.

Grains were obtained with an iodide content in the core which decreased gradually towards a zero value at the interface, the total iodide concentration in the core being 18% molar as with the reference emulsions.

Emulsion C according to the invention contained the same quantity of mercury salt as emulsion A, and emulsion D according to the invention contained no anti-fogging agent.

EXAMPLE 3

Comparative Results in Relation to Fog and Sensitivity

Emulsions A, B, C and D were optimally sensitized chemically and spectrally. For this purpose, chemical sensitization was carried out with sodium thiosulphate pentahydrate and potassium tetrachloroaurate in the presence of sodium thiocyanate for 20 minutes at 70° C. Then the sensitizing dye anhydro-5-chloro-9-ethyl-5'-phenyl-3'-(3-sulfobutyl)-3-(3-sulfopropyl)oxacarbocyanine hydroxide, sodium salt was introduced.

These emulsions A, B, C and D were coated on a cellulose triacetate support with a silver content of 0.81 g/m$^2$ and a gelatin content of 2.37 g/m$^2$. These emulsions were coated with a top coating comprising 2.37 g/m$^2$ of gelatin.

The films obtained were exposed after 72 hours at 20° C., 50% relative humidity (RH) and after 7 days at 50° C. and 50% RH to a green light of 5500° K. for 0.01 second and were developed using a standard Kodak E6 processing for reversal products which comprises the following stages:

Black and white development in the presence of a solvent for silver halides
Washing
Reversal bath
Chromogenic development (38° C.)
Washing
Bleaching
Fixing
Washing
Stabilizing.

The relative sensitivity was assessed with respect to the reference emulsion A, to which a sensitivity of 100 is allocated. The sensitivity is defined as $$\text{sensitivity} = 100\ (1\text{-log } E)$$

where E is the photographic exposure in lux-seconds required for obtaining a density $D = D_{max} - 0.3$ and $D_{max}$ represents maximum density.

The fog in the sensitometric curve for negative products corresponds to $D_{min}$ (see T. H. James, *The Theory of the Photographic Process*, 4th Edition, published by Macmillan, page 501 "Characteristic curve". Since the fog of reversal products appeared on the sensitometric curve as a loss of $D_{max}$, a special E6 processing was carried out, known as "E6 rehalo", which comprised an additional sequence of fixing/washing/bleaching-/washing before the reversal stage of the E6 processing. The level of fog is expressed as a percentage.

$$\%\ \text{fog} = 100\ D_{min}/D_{max}$$

$D_{min}$ being the minimum density and $D_{max}$ the maximum density obtained with the rehalo processing.

The following results were obtained:

| | Anti-fogging agent | Relative sensitivity | Fog on fresh product | Fog after incubation |
|---|---|---|---|---|
| A Reference | YES | 100 | 1.8 | 14.4 |
| B Reference | NO | 126 | 9.4 | 40.7 |
| C Invention | YES | 107 | 8.3 | 10.4 |
| D Invention | NO | 116 | 4.0 | 7.9 |

It can be seen by comparing emulsions C and D according to the invention that the elimination of the anti-fogging agent does not affect the level of the fog in the fresh product or after incubation.

In addition, the performance of emulsion D prepared without anti-fogging agent is superior to that of emulsion C according to the invention prepared with an anti-fogging agent derived from mercury and to that of reference emulsion A containing a mercury derivative.

These examples show that it is possible to eliminate anti-fogging agents in core/shell emulsions according to the invention without the level of fog increasing and without any degradation of the sensitivity.

EXAMPLE 4

Cubo-octahedral core/shell emulsions E, F and G having ECD grain diameters of 0.4, 0.7 and 1.2 μm, respectively, were prepared using the process according to the invention. The iodide concentration in the core varied by around 36% at the center of the grain and 0% at the core/shell interface and the thickness of the bromide shell was 0.1 μm in all cases.

| | Anti-fogging agent | Relative sensitivity | Fog on fresh product | Fog after incubation |
|---|---|---|---|---|
| E Invention | NO | 84 | 1.6 | 2.9 |
| F Invention | NO | 120 | 4.1 | 10.0 |
| G Invention | NO | 142 | 7.6 | 11.5 |

These examples show that the process according to the invention makes it possible to prepare emulsions which inherently have a low fog level, whatever the grain size.

EXAMPLE 5

In this example, the distribution of iodide in the grains was studied. To this end, using the process according to the invention, a core/shell emulsion was prepared with an iodide profile in the core containing a total iodide concentration of 2.7% molar and having an ECD grain diameter of 0.7 μm, according to the process of the invention. The intergrain iodide content was measured by AEM (Analytical Electronic Microscopy). FIG. 1 shows that the standard deviation $\sigma$ is 0.3. The maximum iodide content in the grains was 3.7 and the minimum iodide content 1.3.

It can be seen in FIG. 1 that 75% of the grains have an iodide content of approximately 3%, 25% of the grains have an iodide content of approximately 4% and 10% of the grains have an iodide content of approximately 2%.

These results show that the total iodide content varies little from one grain to another with the process according to the invention.

EXAMPLE 6

An emulsion was prepared comprising 6% molar total iodide with an iodide profile in the core according to the invention and a reference emulsion also comprising 6% molar total iodide distributed homogeneously in the core.

Figure 2:
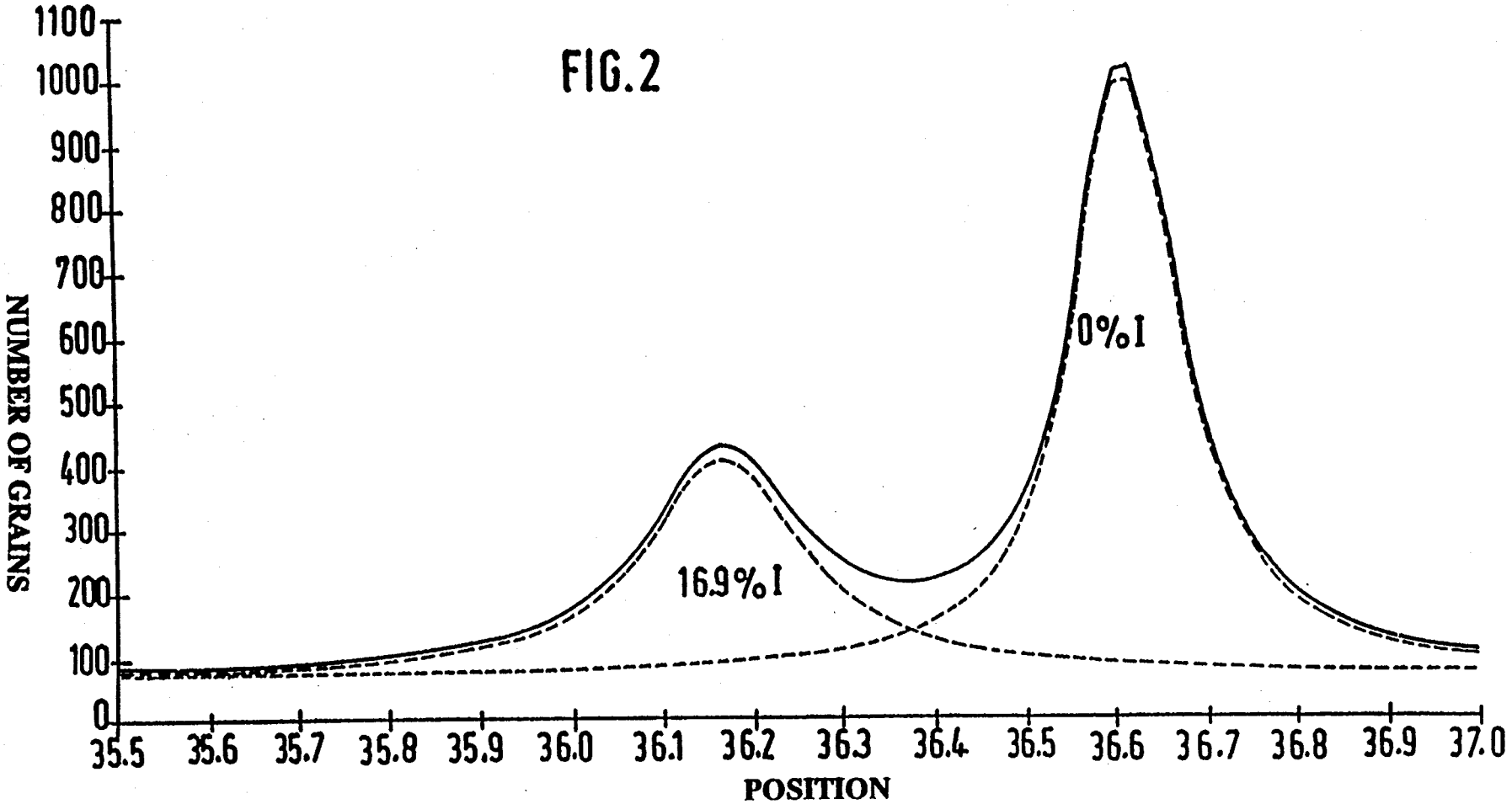
FIGS. 2 and 3 are plots of number of grains versus diffraction position, measured in degrees.
Figure 3:
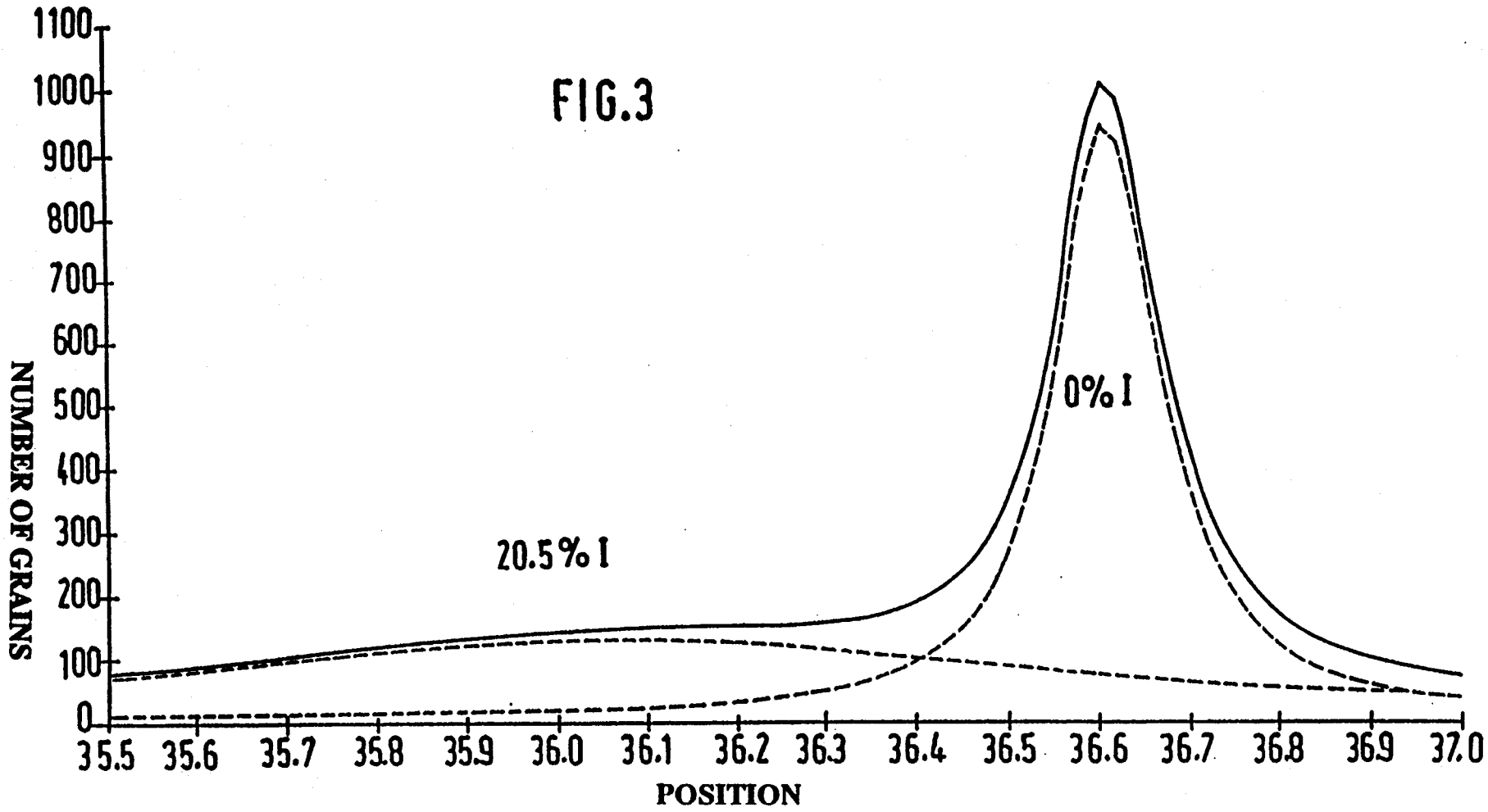

The X-ray diffraction spectrum enabled the position of the iodide in the grain to be located. It can be seen in FIG. 2 that the reference emulsion had two peaks for 16.9% and 0% iodide corresponding to the concentrations of iodide respectively in the core and in the shell, while in FIG. 3 it can be seen that the emulsion according to the invention had no peak for an iodide concentration in the core, which shows an even variation of iodide in the core.

The invention has been described in detail with particular reference to preferred embodiments thereof, but it will be understood that variations and modifications can be effected within the spirit and scope of the invention.

What is claimed is:

1. A process for preparing a photographic emulsion comprising silver halide grains with a core/shell structure, in which successive regions having different silver halide compositions are precipitated by introducing simultaneously a solution of a silver salt and a halide solution of an alkaline metal halide or halides, wherein, during the precipitation of the core, the halide solution contains iodide and at least one of chloride and bromide, the concentration of iodide in the halide solution varying progressively between an initial maximum value and a final maximum value of zero, and during the precipitation of the shell the halide solution contains at least one of chloride and bromide and no iodide.

2. A process according to claim 1, in which during the precipitation of the core the halide in the halide solution consists essentially of iodide and bromide and during the precipitation of the shell the halide in the halide solution consists essentially of bromide.

3. A process according to claim 2, in which during the precipitation of the core the iodide concentration in the halide solution varies between an initial maximum value, which is between 10 and 40 percent on a mole basis of the total halides in the halide solution, and a final minimum value which is zero.

4. A process according to claim 3 in which during the precipitation of the core the initial maximum value of the iodide concentration in the halide solution is approximately 36 percent on a mole basis of the total halides in the halide solution.

5. A light-sensitive emulsion comprised of grains containing a core and a surrounding shell, wherein the core contains iodide and at least one of chloride and bromide, the content of iodide in the core varying progressively from a maximum at the center of the grain to a minimum of zero adjacent the surrounding shell, and the iodide content in the shell is zero.

6. A light-sensitive emulsion according to claim 5 in which the grains are selected from among tabular, octahedral, cubo-octahedral and cubic silver halide grains.

7. A light-sensitive emulsion according to claim 6 in which the grains are comprised of cubo-octahedral silver halide grains.

8. A light-sensitive emulsion according to claim 5 in which the grain core is comprised of silver bromoiodide, chloroiodide, chlorobromoiodide, bromochloroiodide, bromoiodochloride, or chloroiodobromide.

9. A light-sensitive emulsion according to claim 8 in which the grains are comprised of a core of silver bromoiodide surrounded by a silver bromide shell.

10. A light-sensitive emulsion according to claim 9 in which silver is present in the core and the shell in a molar ratio of between 0.2 and 2.

11. A light-sensitive emulsion according to claim 10 in which the molar ratio of silver in the core and the shell is 0.5.

12. A light-sensitive emulsion according to claim 10 in which silver iodide is present in the silver halide grain in an average concentration of between 1 and 10 mole percent.

13. A light-sensitive emulsion according to claim 12 in which the silver iodide is present in the core in an average concentration that ranges from 0.1 to 36 mole percent, based on the silver in the core.

14. A light-sensitive emulsion according to claim 5 in which the grains have a mean grain size of between 0.3 and 2 μm.

15. Light-sensitive emulsion according to claim 14 in which the grains have a mean size of between 0.4 and 1.6 μm.

16. Light-sensitive emulsion according to claim 5 in which the grains have a volume coefficient of variation (COV) of less than 25%.

* * * * *